US005483234A

United States Patent [19]

Carreel et al.

[11] Patent Number: 5,483,234

[45] Date of Patent: Jan. 9, 1996

[54] INSTALLATION FOR INFORMING USERS OF A BUS NETWORK ABOUT WAITING TIMES FOR THE BUSES

[75] Inventors: Eric Carreel, Paris; Jean-Claude Decaux, 88 Boulevard Maurice Barrès, 92200 Neuilly Sur Seine; Jacques Lewiner, Saint Cloud, all of France

[73] Assignee: Jean-Claude Decaux, Neuilly Sur Seine, France

[21] Appl. No.: 253,009

[22] Filed: Jun. 2, 1994

[30] Foreign Application Priority Data

Jun. 4, 1993 [FR] France ..... 93 06725

[51] Int. Cl.[6] ..... G08G 1/123

[52] U.S. Cl. ..... 340/994; 340/988

[58] Field of Search ..... 340/994, 988, 340/905, 995, 932.2, 928

[56] References Cited

U.S. PATENT DOCUMENTS

| | | | |
|---|---|---|---|
| 4,350,969 | 9/1982 | Greer | 340/994 |
| 4,730,285 | 3/1988 | Lie | 368/90 |
| 4,799,162 | 1/1989 | Shinkawa et al. | 340/994 |
| 4,857,925 | 8/1989 | Brubaker | 340/994 |
| 5,021,780 | 6/1991 | Fabiano et al. | 340/994 |
| 5,086,389 | 2/1992 | Hassett et al. | 340/928 |
| 5,168,451 | 12/1992 | Bolger | 340/994 |
| 5,339,000 | 8/1994 | Bashan et al. | 340/932.2 |
| 5,343,237 | 8/1994 | Morimoto | 340/932.2 |

OTHER PUBLICATIONS

Applicant admitted prior art of French patent #9209042 in the disclosure of this application.

*Primary Examiner*—Brent A. Swarthout
*Assistant Examiner*—Benjamin C. Lee
*Attorney, Agent, or Firm*—Larson and Taylor

[57] ABSTRACT

The installation is intended to inform users of a bus network about waiting times for buses at stops in the network, the installation including a central station suitable for transmitting radio signals relating to the real instantaneous positions of the buses and portable receiver appliances (1) suitable for displaying waiting times on their own screens (3). Each appliance has an appliance identification symbol recorded therein and also (at 11) an expiry date, and it is possible to obtain the desired displays on the screen only if said appliance is used earlier than said date. Provision is made for renewing the appliance remotely for new subscription periods at the end of each subscription.

5 Claims, 1 Drawing Sheet

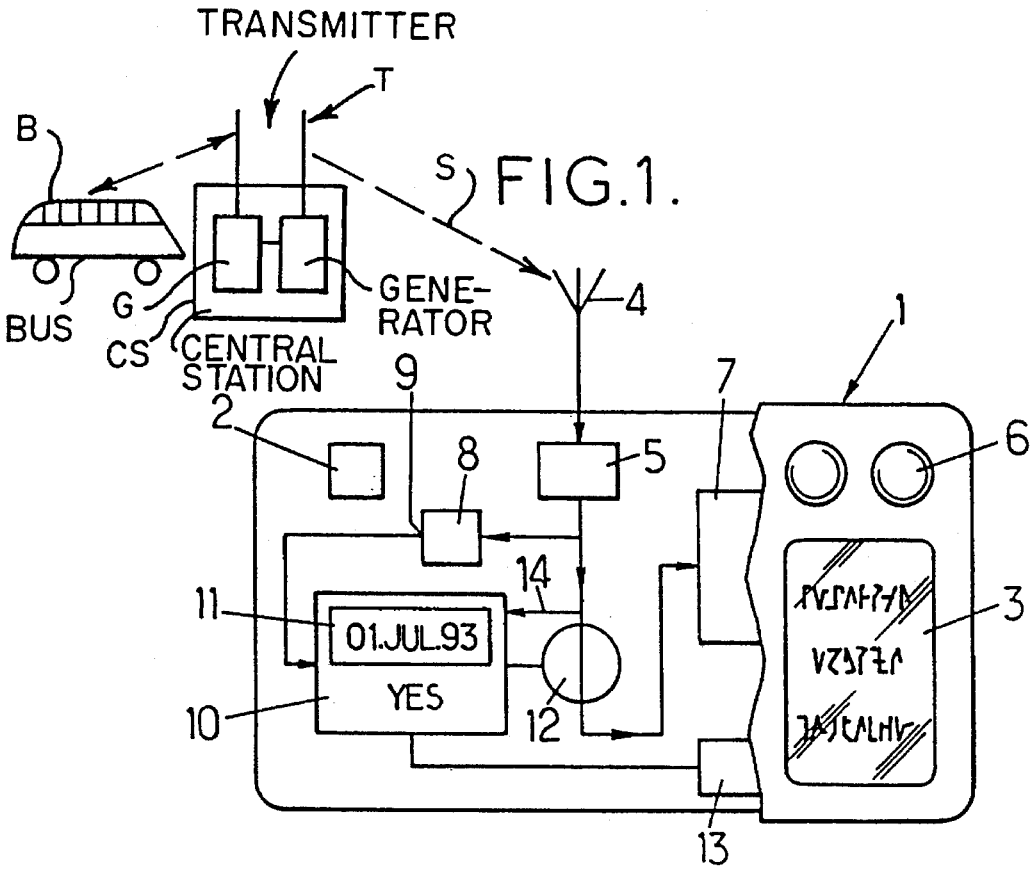
FIG.1.
FIG.2.
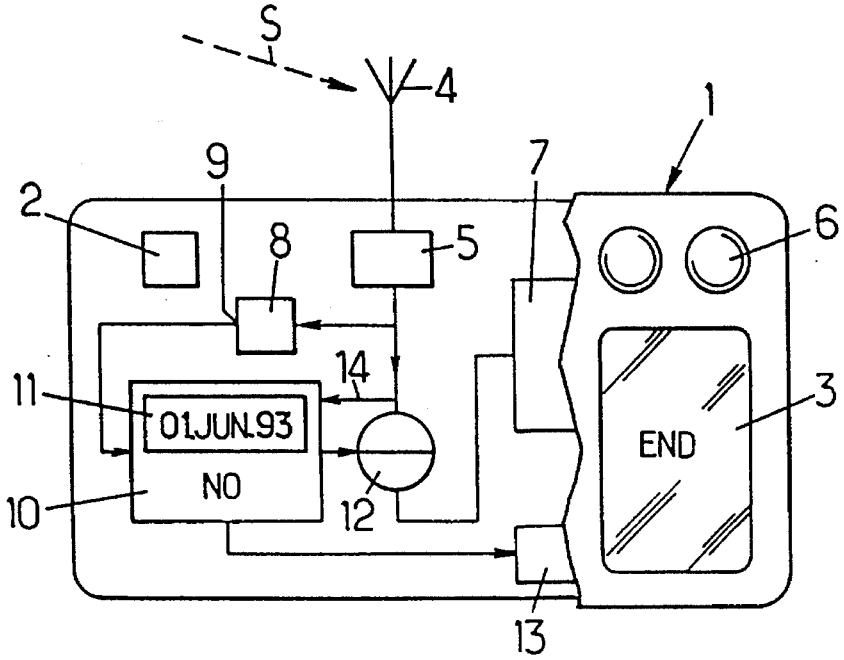

INSTALLATION FOR INFORMING USERS OF A BUS NETWORK ABOUT WAITING TIMES FOR THE BUSES

The invention relates to installations designed to inform the users of a bus network about waiting times for buses at the stops in the network.

More particularly, it relates to such installations that comprise: firstly, means themselves including a central station for collecting data identifying the instantaneous positions of various buses travelling along the various lines of the network, means for generating electrical signals on the basis of said data for the purpose of providing information about said positions, and means for transmitting said signals over an electromagnetic path; and also a plurality of portable receiver appliances each including means for receiving the above signals and for selecting from said signals those relating to the buses expected at a given stop of a given line of the network, and means for making use of the signals selected in this way for the purpose of displaying the waiting times for said buses at said stop.

Such an installation has been described, for example, in the present Applicant's French patent number 92 09042.

Such installations are highly advantageous for users holding the above portable appliances since such users can find out when "next buses" are expected at the bus stops that they intend to use for catching a bus, thereby enabling them to organize their time immediately preceding the catching of a bus at the desired bus stop in a manner that is more efficient and more restful than would otherwise be the case.

An object of the present invention is to further improve such installations in various respects.

In this context, it should be observed that the service constituted by informing users of the network about waiting times for the buses that the users seek to catch implies costs associated with equipment, operation, updating, etc.

The undertaking managing the service may seek to recover its costs solely when users acquire their portable receiver appliances.

Under some circumstances, that technique can give satisfaction.

However, it may also suffer from various drawbacks, in particular from the following drawbacks:

- the sale price of each appliance may be perceived by a potential user as being rather high, thereby slowing down the rate at which such appliances are issued and thus limiting the profitability of the installation; and
- the above technique does not take any account of the length of time during which each appliance is in use, and that is unfair, penalizing use over a short period of time compared with use over a longer period of time.

The inventors have therefore had the idea of associating use of the appliances in question with periods of time that are paid for on a subscription basis.

This formula has the great advantage of enabling such portable appliances to be made available to the public free of charge or almost free of charge, with actual use of such appliances being authorized only during appropriate subscription periods in return for the users paying fees pro rata to the operating undertaking.

A particular object of the invention is to make it possible and indeed easy to implement such an operating formula based on subscriptions that are paid periodically.

To this end, according to the invention, portable receiver appliances of the kind in question are essentially characterized in that they comprise:

- an appliance identification circuit itself including a memory that lends itself to recording a coded identification symbol and means enabling said recorded symbol to be compared with symbols of the same type included in the electromagnetic check signals received by the appliance and for making execution of the checking performed by said signals contingent on correct results of such comparisons; and
- a circuit for checking the validity of the appliance, itself comprising a memory lending itself to recording successive code symbols representing expiry dates F and means for comparing the real dates R on which the above-mentioned check signals are transmitted with each date F recorded during a given period, and for making access of signals useful to the operating circuits of the appliance contingent on correct results of said comparisons.

In other words, the appliance is automatically rendered inoperative once the date F has been exceeded, i.e. as soon as the subscription period for which the user has paid the corresponding fee has been completed.

Naturally, the information installation further includes, in its central station, means for generating and transmitting encoded controlling electromagnetic signals serving firstly to be identified by the appliances and secondly for comparing the real date R with the expiry dates F recorded in said appliances.

In preferred embodiments, use is also made of one or more of the following dispositions:

- the memory for recording the expiry dates F is organized in such a manner as to lend itself to replacing each expiry date with another date merely on reception of appropriate electrical signals, the central station being organized in such a manner as to generate and transmit such subscription renewal signals; and
- the portable appliance includes a display screen together with means for displaying on said screen a message in the clear, i.e., in non-encoded language indicating that a subscription has expired and possibly also the consequences to be drawn therefrom as soon as the expiry date F recorded in the appliance has been exceeded.

The invention relates not only to information installations of the kind in question in general, but also to portable receiver appliances included in such an installation.

In addition to the main dispositions explained above, the invention further includes certain other dispositions that are preferably used simultaneously therewith and that are explained in greater detail below.

There follows a description of a preferred embodiment of the invention that is naturally given by way of non-limiting example and that is made with reference to the accompanying drawing.

FIGS. 1 and 2 of the drawing are highly diagrammatic representations of a portable appliance of the invention shown respectively in a valid state within a subscription period and in an invalid state after the subscription has expired.

The idea is to inform users of buses in an urban network seeking to catch such a bus at a given stop on a given line of said network about the real waiting times for the "next buses" expected at said stop.

To this end, and as explained for example in the Applicant's French patent No. 92 09042, portable appliances 1 are provided and made available to users, which appliances are suitable for co-operating with a central station CS which includes a generator G designed to generate information signals S and to transmit them via a transmitting means or transmitter T cyclically over an electromagnetic path, said signals relating to the real instantaneous positions of respective buses B on the network based on signals from the buses B received at the central station CS. Each of said appliances includes an electrical power supply 2, user-actuatable interrogation means suitable for identifying each stop at which it might be desired to catch a bus, means suitable for receiving the above-mentioned signals and for selecting therefrom at least those signals that relate to the "next bus" expected at the identified stop, means suitable for generating information associated with the waiting time for said next bus at said stop, and means including a display screen 3 for displaying said information.

The above-mentioned interrogation, reception, selection, and generating means comprise, in particular, a reception antenna 4, a circuit 5 associated with said antenna for amplification, demodulation, and decoding purposes, control keys 6, and memory and calculation means 7 that are particularly light in weight and compact, in particular of the microprocessor type.

In the embodiments proposed in the above-mentioned patent, the waiting time for a bus can be determined and displayed at any moment, under the control of the keys 6.

In the present embodiments, means are provided for making such operations possible only during predetermined subscription periods that are paid-up, and for automatically preventing such operations at other times.

In each appliance 1, such means comprise:

an appliance identification circuit 8 comprising a memory that lends itself to recording an encoded identification symbol, means enabling said symbol to be compared with symbols of the same kind that accompany certain operational signals S or "check signals", and means for applying the latter signals to the output 9 of said circuit 8 only when said comparison indicates identity; and a circuit 10 for checking the validity of the subscription period, which circuit 10 is connected to the output 9 and includes a memory 11 that lends itself to recording an encoded symbol representing an expiry date F, means for comparing said encoded date with the real encoded date R on which each received check signal is generated, which date accompanies said signal or is determined by a clock carried by the appliance, and means for causing any negative response to said comparison to prevent the operating signals S gaining access to the circuit 7.

In the drawing, said means for preventing access are represented by a barred circle 12 mounted on the conductor interconnecting the two subassemblies 5 and 7.

At 14, there can be seen a conductor connecting the output of the circuit 5 directly to the checking circuit 10.

In addition, the central station of the installation includes means suitable for generating the electromagnetic signals required for operation, signals carrying appropriate codes corresponding to the appliance identification signals, to the real dates R on which said appliances are used, or at least to comparisons between such dates, as generated in the appliances and the dates F recorded therein, and, in the preferred embodiment described below, to the expiry and subscription renewal dates.

It is also possible to cause said central station to include means for recording the identification symbols of the various appliances 1 together with the expiry dates associated with said appliances.

The installation operates as follows.

Assume that the paid-up subscription of the holder of the appliance 1 expires on Jul., 1, 1993 in the example of FIG. 1 and on Jun. 1, 1993 in the example of FIG. 2, and that the appliance is actually being used on Jun. 6, 1993.

In the example shown in FIG. 1, the subscription period corresponding to the appliance 1 has not expired.

Pressing appropriate buttons 6 therefore enables the user to obtain the desired displays of bus waiting times on the screen 3.

The signals S then received by the antenna 4 and processed by the circuit 5 are indeed applied to the processing circuits 7 without being interrupted at the "lock" 12.

The lock 12 is kept in its authorization position for the following two reasons:

the check signals coming from the circuit 5, and then the circuit 8 after identification by the appliance 1, are applied to the circuit 10, and the time comparison then performed therein between the real date R and the date of Jul. 1, 1993 that is recorded therein indicates that the appliance is a valid state at the instant under consideration; and independently of any identification of the appliance, the same time verification can be performed in passing via the connection 14 by any of the operating signals S that carry an appropriate identification of the real date R.

In contrast, in the example of FIG. 2, the subscription period corresponding to the appliance 1 has expired.

Under such circumstances, the operating signals leaving the circuit 5 cannot reach the circuit 7, since they are stopped by the "lock" 12.

The lock is actuated by the fact that the check signals after being applied to the comparator circuit 10 via the circuit 8 or the connection 14 are subjected in said circuit 10 to a negative checking result because the date Jun. 1, 1993 recorded therein has been exceeded: this negative result has the effect of putting the "lock" 12 in its closed position.

User presses on the buttons 6 can then lead to no useful result with respect to the display on the screen 3.

In a preferred embodiment, the above-described locking-out of the appliance by the lock 12 is accompanied by a suitable message being displayed in the clear on the screen 3.

For example, the message may be generated by the circuit given the reference 13 in the drawing.

The message may merely say "subscription expired".

It may be accompanied by instructions in the clear telling the user how to renew the subscription.

In the following preferred embodiment, such renewal of a subscription can be obtained very simply.

The user desiring to renew a subscription expresses that desire to any appropriate person associated with the installation in any desirable manner, e.g. by direct conversation at a ticket office or window, by telephone, by means of an automatic remote terminal device such as that known under the name "Minitel", etc., and simultaneously paying the price that corresponds to the new period of subscription, with it being possible to make the corresponding payment itself in any desirable manner, e.g. by giving details of a credit card belonging to the user, by a standing order on a bank account of the user, etc.

Under such circumstances, the person associated with the installation causes the central station to generate and transmit electromagnetic signals corresponding to the desired new period of subscription.

These signals, which include the new expiry date F' of the subscription together with the identification number of the appliance to revalidated, are sent and received in the manner described above by the circuits 4, 5, 8, and 10, and they are organized so as to replace the expired expiry date F that used to be recorded in the memory 11 of the appliance 1 with the new date F' that is later than the date of the subscription renewal operation.

The appliance 1 is then valid again and the user can use it again throughout the new subscription period.

As a result, and whatever embodiment is used, an installation is provided that serves to inform the users of a bus network, with the structure and the operation of the installation being sufficiently clear from the above.

Compared with presently known installations, the installation of the invention has the advantage of reserving the privileges associated with operation thereof to subscribers who have already paid an appropriate subscription fee: this formula makes it possible, in particular, to issue the portable receiver appliances of the installation on the basis of a small unit acquisition price that may even be free, with the costs of the undertaking that manages the installation subsequently being recovered essentially by way of the subscriptions.

Naturally, and as already appears from the above, the invention is not limited in any way to the applications and embodiments described in detail: on the contrary, it covers any variants thereof, and in particular:

- variants in which the expiry date F corresponding to each appliance is not recorded per se in the appliance, but is recorded in indirect form, e.g. defined by the combination of a subscription starting date and a subscription length running from the starting date;
- variants in which subscription renewals obtained by replacing the expiry date recorded in the memory 11 with a later date are performed by means of signals that are not transmitted over an electromagnetic path, but over a wire;
- variants in which recordings and comparisons relating to the encoded appliance identification signals and the encoded signals representing the dates are grouped together rather than being separate as is assumed above with reference to the circuits 8 and 10; and
- variants in which special codes are allocated to signals for recording repeat subscriptions and/or check signals in order to avoid any risk of fraud.

We claim:

1. An installation for informing the users of a bus network on bus waiting times at stops of the network, the installation comprising means including central station for collecting data identifying the instantaneous positions of various buses travelling along the various lines of the network, means for generating electrical signals on the basis of said data for the purpose of providing information about said positions, and means for transmitting said signals over an electromagnetic path; and a plurality of portable receive appliances each including means for receiving said signals and for selecting, from said signals, selected signals relating to the buses expected at a given stop of a given line of the network, and means for using the selected signals in displaying the waiting times for said buses at said stop, said signals received by said appliances including electromagnetic check signals including coded identification symbols and each portable receiver appliance further comprising an appliance identification circuit including a memory for recording a coded identification symbol, means for comparing said recorded symbol with coded identification symbols included in the electromagnetic check signals received by the appliance to determine whether there is a match and for initiating a validity checking operation based on said check signals contingent on a said match; and a checking circuit for checking the validity of the appliance, said checking circuit comprising a memory for recording successive code symbols representing expiry date F and means for comparing real dates R on which the check signals are transmitted with each expiry dated F recorded during a given period to determine whether there is a correct match, and for making access of signals to operating circuits of the appliance contingent on a said correct match, the central station further including means for generating and transmitting said encoded check signals for identification by the appliances, and for enabling comparing of the real dates R with the expiry dates F recorded in the appliances.

2. An installation according to claim 1, wherein the check signals include encoded portions representing the real dates R on which said signals are transmitted.

3. An installation according to claim 1, wherein the real dates R on which the appliances are operable are determined by clocks carried by the appliances.

4. An installation according to claim 1, wherein the memory in each appliance for recording said expiry dates F enables replacing each expiry date with another date on reception of electrical subscription renewal signals, and central station generates and transmits said subscription renewal signals.

5. An installation according to claim 1, wherein said appliances include a display screen and means for displaying on said screen a message in unencoded language indicating that a subscription has expired as soon as the expiry date F recorded in the appliance has been exceeded.

* * * * *